US008042577B2

(12) United States Patent
Crook

(10) Patent No.: US 8,042,577 B2
(45) Date of Patent: Oct. 25, 2011

(54) SEAM PRESS FABRIC

(75) Inventor: Robert Crook, Wilson, NC (US)

(73) Assignee: Voith Patent GmbH, Heidenheim (DE)

( * ) Notice: Subject to any disclaimer, the term of this patent is extended or adjusted under 35 U.S.C. 154(b) by 971 days.

(21) Appl. No.: 11/654,453

(22) Filed: Jan. 17, 2007

(65) Prior Publication Data

US 2007/0163667 A1 Jul. 19, 2007

Related U.S. Application Data

(60) Provisional application No. 60/759,649, filed on Jan. 17, 2006.

(51) Int. Cl.
*D03D 3/04* (2006.01)
*D21F 7/10* (2006.01)
*D03D 25/00* (2006.01)

(52) U.S. Cl. ..... 139/383 AA; 139/383 A; 162/358.2

(58) Field of Classification Search ..... 139/383 R, 139/383 A, 383 AA, 408, 411, 412, 413, 139/414; 162/348, 358.1, 358.2, 900, 902, 162/903, 904
See application file for complete search history.

(56) References Cited

U.S. PATENT DOCUMENTS 3,097,413 A * 7/1963 Draper, Jr. ..... 34/95
3,283,388 A * 11/1966 Kelleher et al. ..... 28/141
3,392,079 A * 7/1968 Fekete ..... 428/113
3,401,467 A * 9/1968 Koester ..... 34/95
3,492,706 A * 2/1970 Lee et al. ..... 28/100
3,613,258 A * 10/1971 Jamieson ..... 34/95
3,815,645 A * 6/1974 Codorniu ..... 139/383 AA
3,879,820 A * 4/1975 Grieves et al. ..... 28/110
3,900,659 A * 8/1975 MacBean ..... 428/223
3,920,511 A * 11/1975 Grieves et al. ..... 162/348
4,006,760 A * 2/1977 Romanski et al. ..... 139/383 A
4,103,717 A * 8/1978 Clark ..... 139/383 A
4,186,780 A * 2/1980 Josef et al. ..... 139/383 AA
4,206,787 A * 6/1980 Strandly ..... 139/383 A
4,244,084 A * 1/1981 Gisbourne ..... 24/33 C
4,418,726 A * 12/1983 Josef et al. ..... 139/383 AA
4,476,902 A * 10/1984 Westhead ..... 139/383 AA
4,495,680 A * 1/1985 Beck ..... 28/100
4,865,083 A * 9/1989 Cunnane ..... 139/383 AA
4,887,648 A * 12/1989 Cunnane ..... 139/383 AA
5,268,076 A * 12/1993 Best et al. ..... 162/358.2

(Continued)

FOREIGN PATENT DOCUMENTS

EP 1063349 A2 12/2000

(Continued)

OTHER PUBLICATIONS

Communicated dated Jun. 6, 2007 from European Patent Office including European Search Report (dated May 8, 2007) and European search opinion for European patent application No. 07100592.0 (6 pages).

(Continued)

*Primary Examiner* — Bobby Muromoto, Jr.
(74) *Attorney, Agent, or Firm* — Taylor IP, P.C.

(57) ABSTRACT

A press fabric includes a substantially flat inner sleeve having first and second ends; and an outer sleeve around the inner sleeve and comprising at least one machine direction yarn wound around the inner sleeve and defining first and second seam loops at the first and second ends of the inner sleeve. A method for making the fabric is also disclosed.

18 Claims, 1 Drawing Sheet

U.S. PATENT DOCUMENTS

| | | | | |
|---|---|---|---|---|
| 5,476,123 | A * | 12/1995 | Rydin | 139/383 AA |
| 5,875,822 | A * | 3/1999 | Fargeout | 139/383 AA |
| 6,000,441 | A * | 12/1999 | Lee et al. | 139/383 AA |
| 6,223,781 | B1 * | 5/2001 | Yamada et al. | 139/383 AA |
| 6,283,165 | B1 * | 9/2001 | Best | 139/383 A |
| 6,302,155 | B1 * | 10/2001 | Rydin | 139/383 AA |
| 6,349,749 | B1 * | 2/2002 | Quigley | 139/383 R |
| 6,773,553 | B2 * | 8/2004 | Hyvonen et al. | 162/358.2 |
| 6,776,878 | B2 * | 8/2004 | Yook | 162/358.2 |
| 6,872,283 | B2 * | 3/2005 | Best | 162/358.2 |
| 6,998,023 | B2 * | 2/2006 | Crook | 162/358.2 |
| 7,025,095 | B2 * | 4/2006 | Zils | 139/383 AA |
| 7,032,625 | B2 * | 4/2006 | Rydin | 139/383 A |
| 7,036,533 | B2 * | 5/2006 | Eckhardt | 139/383 A |
| 7,141,144 | B2 * | 11/2006 | Rydin | 162/358.2 |
| 7,384,515 | B2 * | 6/2008 | Byfeldt et al. | 162/358.2 |
| 2004/0033748 | A1 * | 2/2004 | Crook | 442/334 |

FOREIGN PATENT DOCUMENTS

| | | | |
|---|---|---|---|
| EP | 1 808 527 | A1 | 7/2007 |
| WO | 2004029357 | A1 | 4/2004 |
| WO | 2006045892 | A1 | 5/2006 |

OTHER PUBLICATIONS

Communication dated Nov. 12, 2009 from European Patent Office for European patent application No. 07100592.0 (3 pages).

* cited by examiner

SEAM PRESS FABRIC

CROSS REFERENCE TO PROVISIONAL APPLICATION

This application claims the benefit of the filing date of provisional patent application 60/759,649 filed Jan. 17, 2006.

BACKGROUND OF THE INVENTION

The invention relates to fabric for paper making machines and, more particularly, to a seam press fabric.

Paper is conventionally manufactured by conveying a paper furnish, usually consisting of an initial slurry of cellulosic fibers, on a forming fabric or between two forming fabrics in a forming section, the nascent sheet then being passed through a pressing section and ultimately through a drying section of a papermaking machine. In the case of standard tissue paper machines, the paper web is transferred from the press fabric to a Yankee dryer cylinder then creped.

Paper machine fabric or clothing is essentially employed to carry the paper web through these various stages of the papermaking machine. In the forming section, the fibrous furnish is wet-laid onto a moving forming wire and water is encouraged to drain from it by means of suction boxes and foils. The paper web is then transferred to a press fabric that conveys it through the pressing section, where it usually passes through a series of pressure nips formed by rotating cylindrical press rolls. Water is squeezed from the paper web and into the press fabric as the web and fabric pass through the nip together. Press fabrics generally comprise a batt of fibers needled to a base fabric. In the final stage, the paper web is transferred either to a Yankee dryer, in the case of tissue paper manufacture, or to a set of dryer cylinders upon which, aided by the clamping action of the dryer fabric, the majority of the remaining water is evaporated.

The base fabrics of press felts are woven endless, whether they are seamed or not, such that the yarns of the weft in the loom lie in the machine direction of the fabric on the paper machine. The weft yarns weave back and forth continuously between the laterally extending edges of the fabric and form a seam loop at the reversals on one side. The two ends formed are then joined together on the machine by means of a pintle wire.

Press felts consist of multiple layers which are secured together by needling. This works by mechanically locking the constituent batt fibers into various layers and in so doing holds them together. In addition, the batt fiber gives a homogenous paper support surface.

Thus, in the paper making industry, paper making felts or fabrics are used to carry the cellulosic material as it is formed into paper, and one such fabric is an endless woven base with a pin seam for securing the ends of the fabric together once the fabric is in place on the machine.

Numerous disclosures have been made in connection with manufacture of pin seam fabrics, including U.S. Pat. Nos. 6,283,165, 6,000,441, 3,283,388 and 4,495,680 as non-exhaustive examples. These teachings and others tend to be costly and slow, and the need remains in the industry for reduced cost and faster delivery time.

It is the primary object of the invention to provide a press fabric which meets these needs.

Other objects and advantages will appear below.

SUMMARY OF THE INVENTION

In accordance with the present invention, the foregoing objects and advantages have been attained.

According to the invention, a press fabric is provided which comprises a substantially flat inner sleeve having first and second ends; and an outer sleeve around the inner sleeve and comprising at least one machine direction yarn wound around the inner sleeve and defining first and second seam loops at the first and second ends of the inner sleeve.

Still further according to the invention, a method for making a press fabric is provided, which method comprises the steps of winding at least one machine direction yarn around an inner sleeve having first and second opposite ends so as to define first and second seam loops at the first and second opposite ends; flattening the inner sleeve; and joining the first and second seam loops.

According to the invention, the inner sleeve can be a woven or non woven base which is preferably formed into an endless loop upon which the machine direction yarns are wound to form an outer sleeve with seam loops. This is particularly advantageous since the seam loops are formed form yarns which are not woven with cross direction yarns, and there are therefore no cross direction yarn knuckles.

BRIEF DESCRIPTION OF THE DRAWINGS

A detailed description of preferred embodiments of the present invention follows, with reference to the attached drawings, wherein.

DETAILED DESCRIPTION

The invention relates to press fabrics and more particularly to a seam press fabric and a method for making same.

Figure 1:
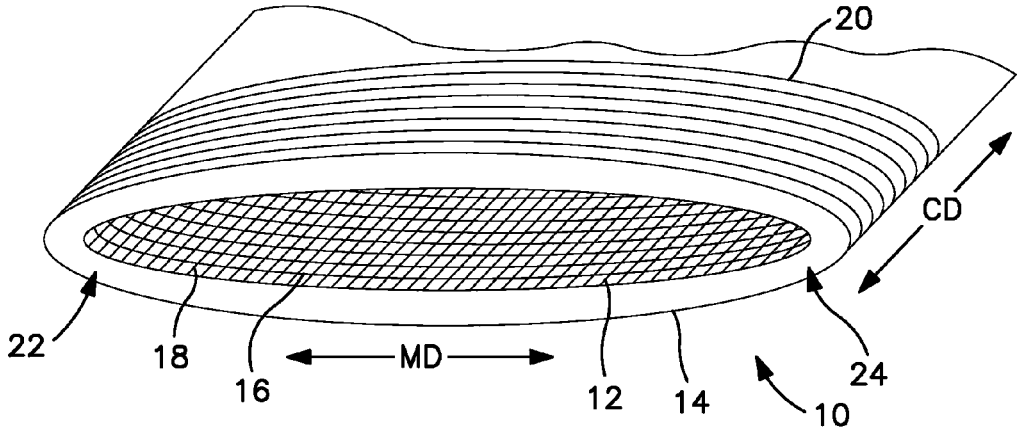
FIG. 1 shows a press fabric according to the invention.

FIG. 1 shows a press fabric 10 according to the invention. Fabric 10 is useful in paper making machines and is mounted in such machines to carry cellulosic material through the various stages of the machine as the material is being formed into paper. One such section is the press section of the machine, and the fabric of the present invention is particularly well suited for use as a press fabric.

As shown in FIG. 1, fabric 10 has an inner sleeve 12 and an outer sleeve 14.

Inner sleeve 12 can be any suitable substrate upon which outer sleeve 14 can be applied, and which will have the appropriate properties for use in a paper making machine fabric. Thus, inner sleeve 12 should be an open structure having void volume for accepting and holding water. One example of suitable material for inner sleeve 12 is an open scrim having machine direction components 16 and cross direction components 18.

Outer sleeve 14 is defined according to the invention by winding machine direction yarn or yarns around inner sleeve 12, preferably in a spiral fashion, such that outer sleeve 14 is formed primarily if not entirely of machine direction yarns 20.

The machine direction is indicated in the drawings as MD, and refers to the direction in which the fabric will move when in use in a paper making machine.

The cross direction (CD in the drawings) is also a direction referred to herein, and refers to the direction transverse to the machine direction when the fabric is used on a paper making machine.

Figure 2:
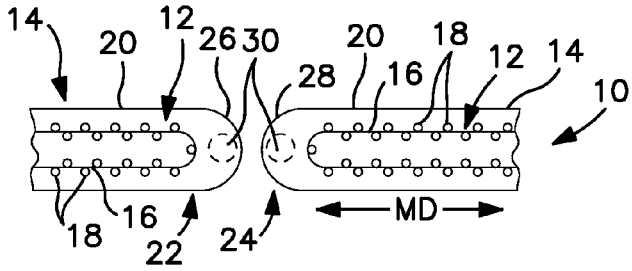
FIG. 2 is a schematic sectional view of the outer sleeve seam portion of the fabric of FIG. 1.

Batt material is typically attached to fabric 10 and can be positioned between inner sleeve 12 and outer sleeve 14. After winding of outer sleeve 14, it should be clear that inner sleeve 12 has two ends 22, 24, and batt material and any CD yarns in areas 22, 24 can be removed to expose seam loops 26, 28 formed from yarns 20 of outer sleeve 14 (See also FIG. 2). At this point, fabric 10 is structurally ready for mounting on a paper making machine, which typically involves feeding the fabric through the various rolls of the machine, preferably using a leader, until the fabric is on the machine with loops 26, 28 substantially adjacent to each other as shown in FIG. 2. These loops can then be pinned, for example using a pintle 30 schematically illustrated in FIG. 2, to join the ends together and finish installation of fabric 10 onto a paper making machine.

It should be appreciated that manufacturing fabric 10 in this manner provides seam loops 26, 28 from machine direction material which is not woven with cross direction material. This is desirable since the machine direction yarns are typically under tension, and when they are woven with cross direction yarns, cross direction knuckles can be formed which are not desirable as they adversely impact the paper product made on the machine.

Figure 3:
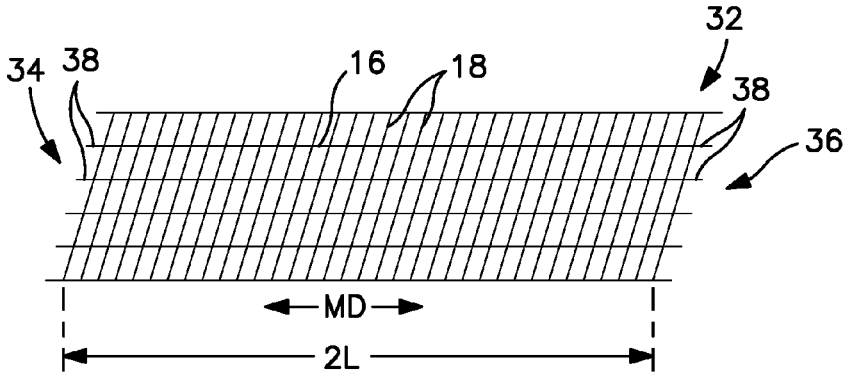
FIG. 3 shows starting material for an inner sleeve according to one embodiment of the invention.

The absence of cross direction yarns in outer sleeve 14 is compensated by the cross direction yarns or components of inner sleeve 12. Thus, one desirable aspect of inner sleeve 12 is a good cross machine direction strength. one way to arrive at this structural strength is to start with a length of open material such as a scrim or the like which has a length that is about twice the length of the desired eventually fabric. This material 32 is shown in FIG. 3 as having a length 2L, that is, a length twice the desired length L of fabric 10. Material 32 can be a woven or non-woven structure, and preferably has a greater number of cross direction threads or components than machine direction threads or components. This is schematically illustrated in both FIGS. 1 and 3 as the spacing between the schematically illustrated yarns or components of inner sleeve 12 in those drawings.

In order to make material 32 into inner sleeve 12, material 32 is preferably wound around rollers or the like and ends 34, 36 are pinned together. Thus, machine direction yarns or components of material 32 can also preferably be formed into inner sleeve seam loops 38 which can be joined to each other as described so as to provide inner sleeve 12 as shown in FIG. 1. Of course, the actual method of preparation of inner sleeve 12 can vary, and although the disclosed embodiment is a particularly preferred embodiment, other materials and manufacturing methods could of course be used for inner sleeve 12, well within the broad scope of the invention.

Suitable material for inner sleeve 12 includes but is not limited to open mesh scrim or screen, thin single layer woven fabric, joined spun bonded fibers, films and the like which preferably have cross direction stability. The material should have minimal machine direction, or warp, yarns. Suitable material could be a 0.005 inch PET, which has good stretch resistance. The machine direction yarns can preferably have a spacing of about 5-25 yarns per inch, preferably 10-15 yarns per inch. Cross direction yarns can be in the typical amounts normally used for such structures. Further, as an alternative and/or enhancement to pin seaming, inner sleeve 12 can be joined using an ultrasonic cutter or the like, and the joint can be reinforced with a thin perforated film or iron-on adhesive if desired.

Another alternative for inner sleeve 12 would be to provide same through a preferably low cost extruded netting process for making the scrim.

Once inner sleeve 12 is provided and formed into an endless loop, machine direction yarns of outer sleeve 14 can be applied.

Machine direction yarns 20 can, as one non-limiting example, be a single mono or plied monofil yarn. Winding of yarn onto inner sleeve 12 can be done from a creel, and reeds can be used to maintain spacing. After winding of the yarns of outer sleeve 14, a batt material is attached to fabric 10 to lock inner sleeve 12 and machine direction yarns 20 of outer sleeve 14 together. The batt can be needle punched, and a low melt adhesive can be used as well.

The composite tube of inner sleeve 12, outer sleeve 14 and batt material is then collapsed to substantially flatten the structure, and batt and any scrim material present at ends defined by the 180° opposite seam loops can be removed to clear the seam loops. Preferably after feeding onto a paper making machine, these loops are joined for example using a pintle. More batt fiber can then be needled into the structure as needed, and a batt flap can be attached to cover the seam if desired.

The final product is a four layer fabric, with two woven inner layers and two outer machine direction only layers. The final product is about half the length of the starting inner sleeve material, and has two superimposed, laminated endless bases. This structure produces excellent pressing uniformity, compaction resistance and void volume capability as well as good fiber bonding and wear resistance, all of which help to satisfy the above identified need in the industry.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

The invention claimed is:

1. A press fabric, comprising:

a substantially flat inner sleeve having first and second ends; and an outer sleeve mounted upon and around the inner sleeve, said outer sleeve being nonwoven, including a plurality of continuous machine direction yarns wound around and mounted upon the inner sleeve, having an absence of any cross-machine direction yarn, and forming first and second seam loops by each of the plurality of continuous machine direction yarns at the first and second ends of the inner sleeve.

2. The fabric of claim 1, wherein the first and second seam loops are secured to each other.

3. The fabric of claim 1, wherein the at least one machine direction yarn is spirally wound around the inner sleeve.

4. The fabric of claim 1, wherein the inner sleeve is a scrim.

5. The fabric of claim 1, wherein the inner sleeve is selected from the group consisting of single layer woven fabric, nonwoven fabric, joined spunbonded fibers, film material and combinations thereof.

6. The fabric of claim 1, wherein the inner sleeve has a greater number of cross direction yarns than machine direction yarns.

7. The fabric of claim 1, wherein the outer sleeve consist essentially of machine direction yarns, whereby the machine direction yarns are substantially free of knuckles from cross direction yarns.

8. The fabric of claim 1, wherein the fabric comprises a four layer structure having two woven inner layers and two machine direction only outer layers.

9. The fabric of claim 8, wherein the outer layers are not interwoven with the inner layers.

10. The fabric of claim 1, further comprising at least one batt layer bonded to at least one of the inner sleeve and the outer sleeve.

11. A method for making a press fabric, comprising the steps of:

providing an outer sleeve which is nonwoven, includes a plurality of continuous machine direction yarns, and has an absence of any cross-machine direction yarn;

winding the plurality of continuous machine direction yarns around, and mounting the plurality of continuous machine direction yarns upon, an inner sleeve having first and second opposite ends such that each of the plurality of continuous machine direction yarns forms first and second seam loops at the first and second opposite ends;

flattening the inner sleeve; and joining the first and second seam loops.

12. The method of claim 11, wherein the winding step comprises spirally winding the at least one machine direction yarn around the inner sleeve.

13. The method of claim 11, further comprising providing the inner sleeve in an open position, and wherein the winding step comprises winding the at least one machine direction yarn around the sleeve in the open position.

14. The method of claim 13, wherein the step of providing the inner sleeve comprises providing an inner base fabric having a length of about twice as long as a desired length of the final fabric; and joining ends of the inner base fabric to define the inner sleeve.

15. The method of claim 14, wherein the inner base fabric has a greater number of cross direction yarns per inch than machine direction yarns per inch.

16. The method of claim 11, wherein the inner base fabric comprises a scrim.

17. The press fabric of claim 1, wherein the outer sleeve includes a plurality of the machine direction yarn and has an absence of any cross-direction yarn.

18. The method of claim 11, wherein a plurality of the machine direction yarn forms an outer sleeve which has an absence of any cross-direction yarn.

* * * * *